United States Patent [19]

Lambert, Jr. et al.

[11] 4,333,644

[45] Jun. 8, 1982

[54] HACK-SQUAT MACHINE

[76] Inventors: Lloyd J. Lambert, Jr.; Lloyd J. Lambert, Sr., both of 1538 College Ave., South Houston, Tex. 77587

[21] Appl. No.: 113,687

[22] Filed: Jan. 21, 1980

[51] Int. Cl.[3] ..... A63B 21/06

[52] U.S. Cl. ..... 272/118; 272/134

[58] Field of Search ..... 272/118, 117, 134, 143, 272/DIG. 4

[56] References Cited

U.S. PATENT DOCUMENTS

| | | | |
|---|---|---|---|
| 3,622,154 | 11/1971 | Williams | 272/134 X |
| 3,866,914 | 2/1975 | Jackson | 272/117 X |
| 4,195,834 | 4/1980 | Lambert | 272/118 |

*Primary Examiner*—Richard C. Pinkham
*Assistant Examiner*—William R. Browne
*Attorney, Agent, or Firm*—Victor J. Evans & Co.

[57] ABSTRACT

Disclosed herein is a hack-squat machine in which hips, thighs, hamstrings, calves, and lower back muscles are exercised. The device includes a base frame, a weight cage having a plurality of weights supported therein, and a drive system including sprockets, a cam and chain drive attached to a padded back support which is disposed upon a trackway. One's feet are placed upon an inclined platform the angle of which is adjustable and the exercise comprises sliding the back support up and down the trackway. The back support is provided with a sled disposed between the trackway and a back face of the back support that is capable of engaging and disengaging so that the back support can be advanced up and down the trackway without the encumbrance of the weights so that an exerciser can not only vary the degree to which the squat exercise will be performed, but also will allow one to disengage the exercise at any time should the need arise.

10 Claims, 8 Drawing Figures

FIG. 5
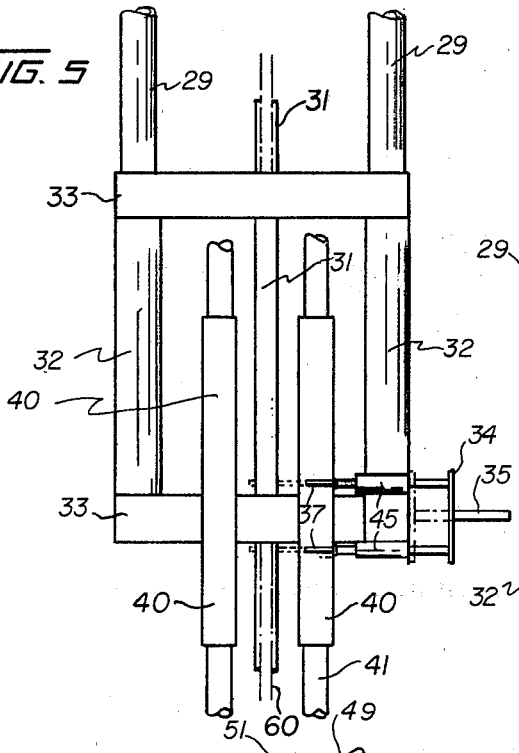
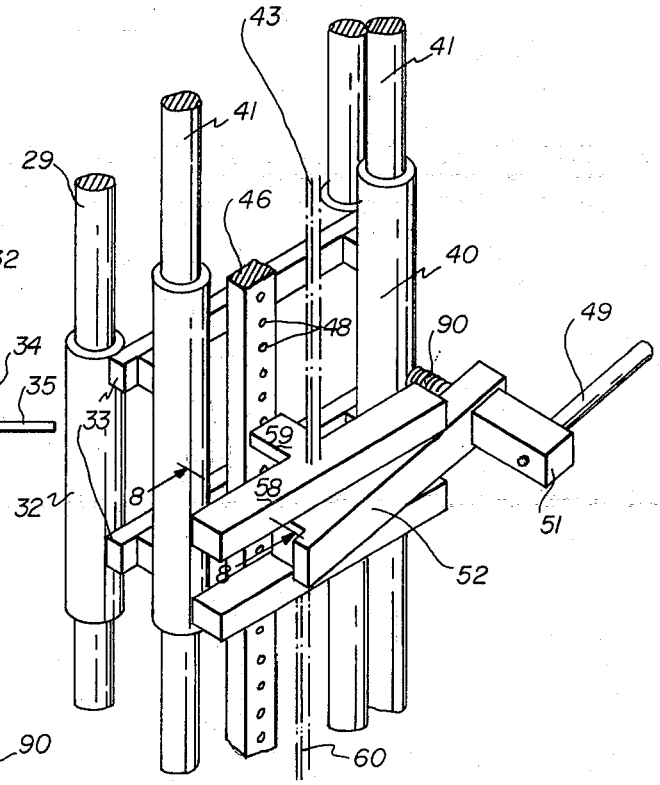
FIG. 6
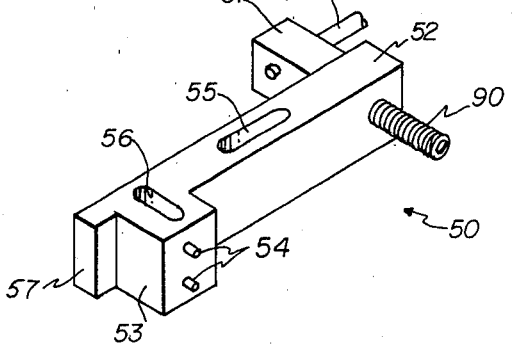
FIG. 7
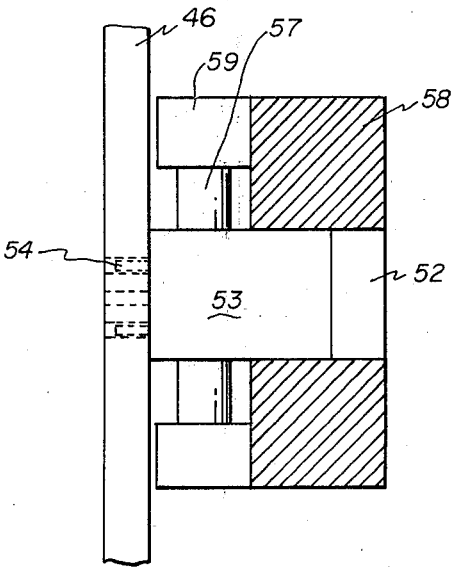
FIG. 8

HACK-SQUAT MACHINE

BACKGROUND OF THE INVENTION

The benefits derived from exercising one's hips, thighs, hamstrings, calves, and lower back are sufficiently important and well-known not to require elaboration here. However, conventional machinery which provides this beneficial exercise has been woefully deficient in assuring that the exerciser can adapt and vary the machine according to physical demands, or immediately disengage the machine should it be necessary. Prior art devices of which applicant is aware include conventional barbells which do not assure the total isolation of the muscle to be developed, and machines in which the back support is disposed upon a substantially triangular framework including a weight cage, a base and the hypotenuse of a triangle upon which the back support lies that is not adjustable relative to the trackway. Clearly, the situation may arise in which one wishes to disengage the machine prematurely relative to a complete repetition of the exercise (for example due to excessive weight, or a muscle failure, etc.); and this has been one difficulty in performing the exercise.

Further, it may be desirable to perform the exercise in which the back portion of the thigh does not always need to be folded at the knee to such an extent that it almost touches the heels of one's shoes, and a prevalent problem is to provide a reliable stop mechanism so that the range of the exercise and its motion can be limited. This is particularly true in people that are recovering from knee injuries.

SUMMARY AND OBJECTS OF THE INVENTION

Accordingly, the ensuing detailed description and drawings are directed to a machine in which the orientation of the back support is adjustable relative to the trackway upon which the back support is disposed.

A further object is to provide a device of the character described above in which the exercise can be discontinued along any portion of the cycle without a deleterious effect upon the user.

It is a further object of this invention to provide a machine of the character described above which can be adjusted to accommodate people of different dimensions.

It is yet a further object of this invention to provide a machine of the character described above which can provide limited stops on the total extent of one's cycle of the exercise.

It is still a further object of this invention to provide a machine of the character described above which is extremely safe to use, durable in construction, and relatively inexpensive.

Another object is to provide a machine of the character described above which isolates certain muscles and assures that these muscles will be exercised to the exclusion of others.

These and other objects will be made manifest when considering the following detailed specification when taken in conjunction with the appended drawing figures.

BRIEF DESCRIPTION OF THE DRAWINGS

FIG. 5 is a planar view of the engagement device shown in FIGS. 3 and 4.

FIG. 6 is a perspective view of a second form of the invention.

FIG. 7 is a perspective view of the actuating element shown in FIG. 6.

FIG. 8 is a sectional view taken along lines 8—8 of FIG. 6.

BRIEF DESCRIPTION OF THE PREFERRED EMBODIMENT

Figure 1:
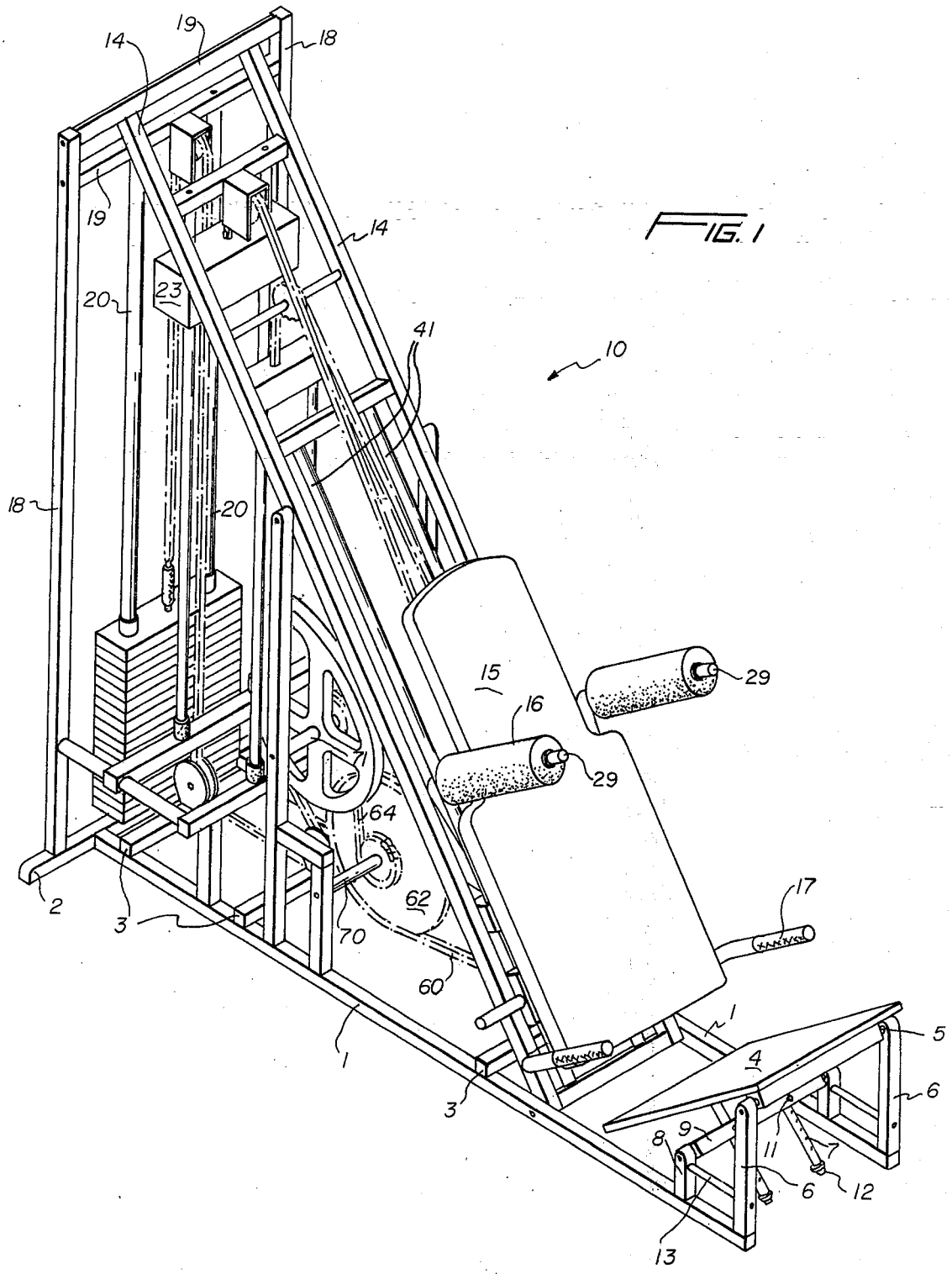
FIG. 1 is a perspective view of the apparatus according to the present invention.

Referring to the drawings now, wherein like reference numerals refer to like parts throughout the various drawing figures, reference numeral 10 is directed to the hack-squat machine according to the present invention.

The hack-squat machine 10 can generally be regarded as having a base frame formed from a pair of spaced parallel bar members 1 interconnected at one extremity by a cross-bar 2 thereby defining an open-ended rectangular grid.

Along the length of the bar members 1 there are provided plural braces transverse and extending therebetween so as to further rigidify the base frame. At one extremity of the base frame extending upwardly from the cross-piece 2 there is a provided a weight cage which includes at least two upwardly extending vertical columns 18 inter-braced at a topmost extremity by means of cross-piece 19. A second cross-piece 19 somewhat lower therefrom is provided for rigidification and also to support two rods 20 upon which a plurality of weights W are slidably disposed. The second mentioned cross-piece 19 also serves to carry a sprocket 27 which forms a part of the drive mechanism.

From a side view therefore the base and vertical columns form two sides of a triangle the hypotenuse of which bears reference numeral 14 and can conveniently be regarded as a pair of spaced parallel back support frame members 14. Parallel to the back support frame members 14 and inwardly thereof are a second pair of rods 41 that extends substantially to a forward area of the base.

Forward of the back support members 14 supported on the base there is disposed a platform 4 capable of angulation relative to the back support frame members 14 including a pair of upwardly extending platform supports 6 interconnected by an axle 5 upon which the platform 4 pivots. An apertured rod 12 having holes 7 is provided at a lower portion of the platform 4 in order to fixedly support the platform 4 in a plurality of positions. This is done by engaging pin element 11 within holes provided on crossbar 9 through which apertured rod 12 extends. As shown in FIG. 1, the crossbar 9 is supported by upstanding bar elements 8 inter-braced with the platform support 6 by pins 13.

The drive mechanism extending between the weights W and the back support 15 can now be defined. A first chain 67 attaches to a stack of weights the magnitude of which is adjustable as is well known and extends over the sprocket 27, thence downwardly to a further sprocket 69 supported on the brace 3 of the base. Thereafter, the chain 67 extends towards the front of the machine in a horizontal fashion under and in front of sprocket 68 thence upwardly where it is wrapped upon cam 66 whose benefits have been delineated elsewhere. The cam 66 is supported upon an axle 71 which straddles a pair of upstanding columns 72 which extend between the base and the back support members 14. Also carried on axle 71 is a further sprocket 65 upon which a second chain 64 is provided that terminates in a lower axle 70 by virtue of a small sprocket 63. A shorter column 74 carries axle 70 and is braced with column 72 by means of crossbar 73. A larger sprocket 62 is similarly supported and co-rotates with sprocket 63, and a third chain 60 extends forwardly of the machine and under and in front of sprocket 61.

The back support and structure associated therewith can now be explained in light of the effect it has on the chain and drive mechanism. In one form, the back support 15 is defined as a substantially rectangular padded member having an upwardly extending tongue of narrower proportions on either side of which a pair of shoulder pads 16 are disposed. The shoulder pads 16 have a generally cylindrical configuration and are supported on a rod 29 of substantially J-shaped configuration. Two such J rods are disposed in parallel relationship and inter-braced at top and bottom extremities by means of T bars 30, the base portion of the T bar of each extremity being inter-connected by means of a lockout bar 31 having plural spaced apertures 39 along one side thereof. The back face of the back support 15 is firmly affixed to each of the T bars 30 in a manner well-known in the art.

Figures 2, 3, 4:
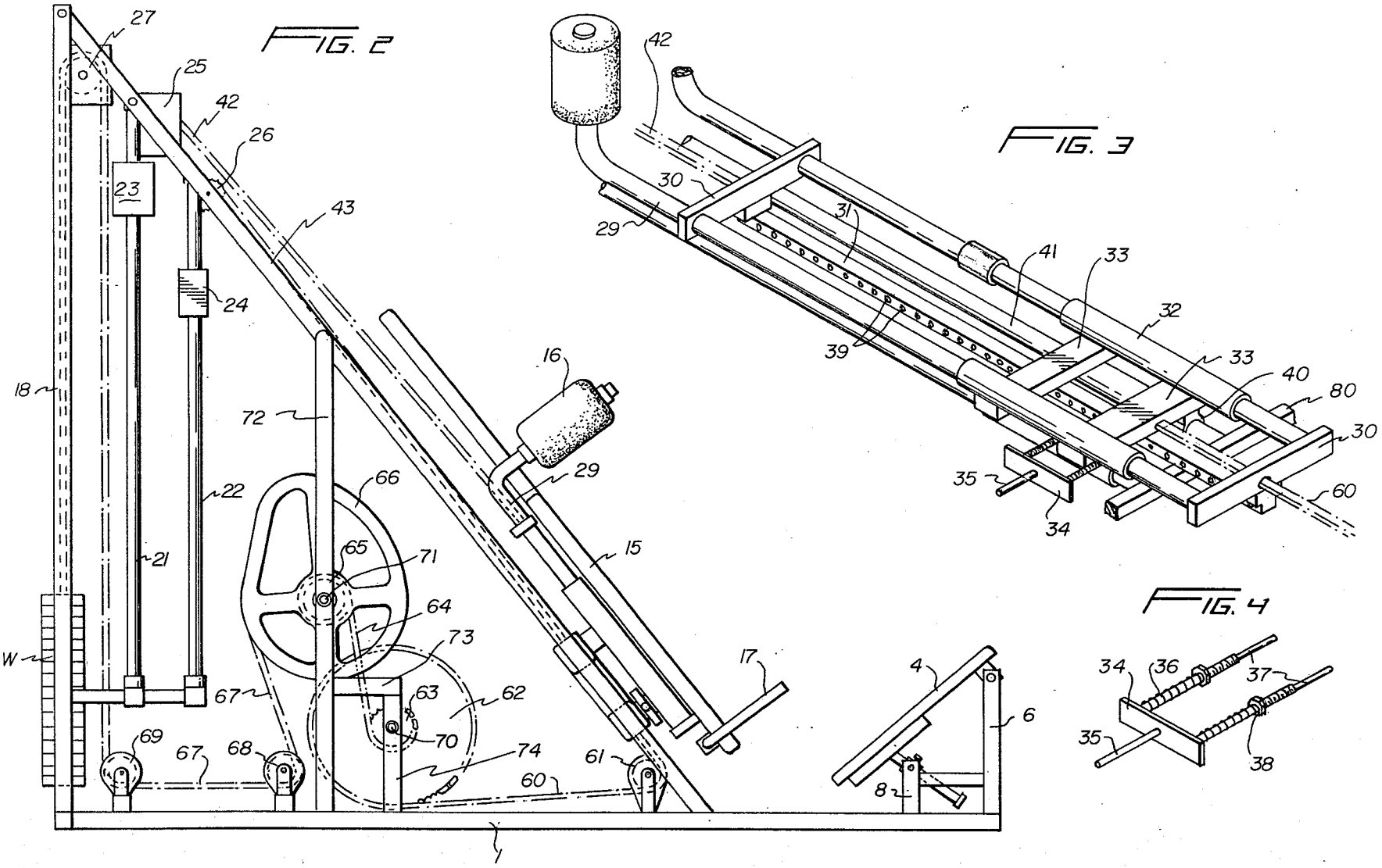
FIG. 2 is a side view thereof.
FIG. 3 is a perspective view of the sled mechanism which adjusts the relationship between the back support and the trackway.
FIG. 4 is a perspective view of the engaging device shown in FIG. 3.

The J bars 29 are slidably disposed through two tubular guides 32 which overlie the J bar and are inter-connected by means of an upper and lower struts 33. On a back face of the strut 33 there is provided a second pair of spaced parallel tube guides 40 which are slideably disposed upon the rods 41. Given the arrangement as it now stands, through the tubular guides 32 the J rods 29 are free to traverse up and down on bearings B. However, the back face of the lower strut 33 is provided on opposed sides thereof with sleeves 45 within which the lockout handle 35 is deployed. Specifically, the lockout handle 35 interconnects a pair of spaced parallel pins 37 by means of crossbar 34. Springs 36 are disposed in front of the sleeve 45 so that when the handle 35 is pulled outwardly, the springs are under tension. However, when the handle 35 is released, the pins 37 extend within the apertures 39 of the lockout bar 31. When this occurs of course the possibility of free travel of J rod 29 is no longer possible. The net effect of this relative translation however is that the back support 15 (and the shoulder pads 16) actually travel up a portion of the length of rods 41 thereby increasing the distance between the back support 15 and platform 4. In order to assist this orientation, a pair of handle members 17 having a U-shaped configuration attached to the back face of the support 15 are provided. As shown in FIG. 3, rods 41 terminate in a transverse bar 80 which terminates along each of back support members 14. Thus, a means for orienting the height of the back support 15 has been provided in which the handle 35 is pulled outwardly from apertures 39 on the side of lockout bar 31.

In an alternative preferred form however, actuation of the handle in such a manner that it requires less effort and provides a greater mechanical advantage is achieved by providing a mechanism in which the handle 35 is actuated by pulling the handle forward towards the front of the person's body rather than outward away from the person's body. FIG. 6 details such an arrangement.

As shown, reference numerals referring to similar parts bear similar legends, and the notable differences will now be explained. In this instance, the lockout bar 46 is provided with apertures 48 along a rear face thereof and the second pair of tube guides 40 are interconnected by upper and lower T bars 58 whose base 59 terminates just above the apertured face. Sandwiched in between the two T bars 58 is the actuater pivot handle 50 affixed to the upper and lower T bars 58 by means of a pivot area defined by an elongate slot 55 on the pivot handle 50. A handle grip 49 has a cylindrical configuration and terminates in the major block member conveniently defined by a Z shape with one leg 51 of the Z connected to the handle grip 49, the main base 52 having the substantially medially disposed slot 55, and the third leg 53 having at its terminal extremity at least two locking pins 54. Top and bottom faces of the third leg 53 are provided with elongate notches 56 therein which as shown in FIG. 8 serve as a support for upper and lower guides 57 a portion of which nest within the notch 56 so as to minimize lateral deflections. Spring 90 causes the handle 50 to reset in a locked position.

The weight of the back support and tubular sliding members are off-set by means of counter-balances. This allows frail people, children or women, to maneuver these elements as through they were weightless so that a minimum amount of weight can be used for rehabilitation or the like. To this end, a first chain 42 extends from the uppermost T bar 30 upwardly to a sprocket 25 and downwardly to a counter-balanced weight 23 supported on rod 21 as best seen in FIGS. 2 and 3. A second counter-balance weight 24 similarly supported on rod 22 extends over a further sprocket 26 and thereafter along the length of the back support members 14 and terminates on the upper strut 33. Clearly, the magnitude of the counter-balanced weights 23 and 24 are such that the weight of the components that counter-balance can be moved up and down the rods with virtually no resistance. The chain 60 can be seen in FIG. 3 to extend upwardly from sprocket 61 and through the lower T bar 30 by means of an aperture and terminate on the lower strut 33 so that when the system is locked out and the apertures on the lockout bar are constrained by pins as explained herein above, work can be done by translating the chain 60. It should be apparent that the counter-balanced weights will still be operative so that the weight displayed in the weight stack will truly reflect the amount of work being done.

Having thus described the invention it should be apparent that numerous structural modifications are contemplated as being a part of this invention as set forth herein above and as defined herein below by the claims.

What is claimed is:

1. A squat and hack machine comprising in combination:

a base frame having a weight supporting cage extending upwardly therefrom and including weights therein, a back support frame extending from a top of said weight cage to said base frame, a pair of spaced parallel first rod members inboard of said back support frame and supported thereby, sled means for supporting a user, said sled means being slideably disposed on said first rod members, said shed means including a back support and second rod members, said back support being attached to said second rod members, said second rod members slideably disposed within said sled means, means on said second rod members to selectively lock said second rod members to said sled means whereby when unlocked, said second rod members and therefore said back support can be adjusted independently of said weights along said back support frame, and when locked said weights are operatively connected to said back support during an exercise.

2. The device of claim 1 wherein said sled means and said back support are provided with counterbalance means to negate their intrinsic weight.

3. The device of claim 2 wherein said second rod members (29) are interconnected at upper and lower extremities by bar members (30) each having one side fastened to a rear face of said back support and an opposed side carrying a lockout bar interposed between said bar members, said sled means includes a first pair of spaced parallel tubular guides (32) through which said second rod members are slideably disposed, a second pair of spaced parallel tubular guides (40) depending from transverse means and interconnecting said first pair, and a lockout handle means affixed to one pair of guides and connectable to said lockout bar whereby when thus connected said sled is engaged and said second rod members are locked to said sled.

4. The device of claim 3 wherein said second pair of tubular guides is slideably disposed on said first rod members.

5. The device of claim 4 wherein said counterbalance means comprises a first counterbalance weight connected to said upper bar member (30) through first chain means, said first counterbalance weight depending from a first sprocket means carried on said back support frame members.

6. The device of claim 5 wherein said counterbalance means includes a second counterbalance weight connected to said transverse means extending between one pair of said tubular guides through second chain means, said second counterbalance weight depending from a second sprocket means carried on said back support members.

7. The device of claim 6 wherein said lockout handle means comprises a handle disposed between and pivoted along said transverse means, said handle provided with biasing means to naturally urge said locking pins into locking engagement.

8. The device of claim 6 wherein said lockout handle means comprises locking pins oriented to face and engage apertures disposed on said lockout bar, said locking pins interconnected at termini remote from said lockout bar by a crossbar having a handle carried thereon, said locking pins slideably disposed in sleeves supported by said transverse means, and biasing means on said locking pins to cause said pins to normally engage said apertures on said lockout bar.

9. The device of claims 7 or 8 wherein said second rod members have an upper terminus which extends outwardly past said back support, and pads disposed thereon for engagement with an exerciser's shoulders, a foot rest disposed on said base frame remote from said weight cage provided with means for angulation.

10. The device of claim 3 wherein said weights are operatively connected to said transverse means.

* * * * *